US006851968B2

(12) United States Patent
Tsunematsu

(10) Patent No.: US 6,851,968 B2
(45) Date of Patent: Feb. 8, 2005

(54) ELECTRICAL CONNECTOR FOR FLAT TYPE CONDUCTOR

(75) Inventor: Kazuhisa Tsunematsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 36 days.

(21) Appl. No.: 10/464,463

(22) Filed: Jun. 19, 2003

(65) Prior Publication Data

US 2004/0002254 A1 Jan. 1, 2004

(30) Foreign Application Priority Data

Jul. 1, 2002 (JP) ..... 2002-191774

(51) Int. Cl.[7] ..... H01R 12/24
(52) U.S. Cl. ..... 439/495; 439/67
(58) Field of Search ..... 439/495, 67, 496, 439/493, 260, 79, 924.1

(56) References Cited

U.S. PATENT DOCUMENTS 4,718,859 A * 1/1988 Gardner ..... 439/329
5,458,506 A * 10/1995 Yamaguchi et al. ..... 439/495
5,785,549 A * 7/1998 Takayasu ..... 439/495
5,839,917 A * 11/1998 Takahashi et al. ..... 439/495
6,471,541 B2 * 10/2002 Kunishi et al. ..... 439/495
2002/0045374 A1 4/2002 Kunishi

FOREIGN PATENT DOCUMENTS

JP 07-142130 6/1995
JP 2001307804 4/2002

* cited by examiner

*Primary Examiner*—P. Austin Bradley
*Assistant Examiner*—Edwin A. Leon
(74) *Attorney, Agent, or Firm*—Takeuchi & Takeuchi

(57) ABSTRACT

An electrical connector for a flat type conductor comprises terminals (20) with contact portion brought into contact with the flat conductor (F) when the flat conductor moves to the the closed position, and a pressing member (40) rotatable between the open and closed positions, wherein each terminal includes a base (21) and a main arm (22) having a first arm portion (24) and a second arm portion (25), at least one of the first and second arm portions having a sub-arm portion (27 and 33). When the pressure member is moved to the closed position, the sub-arm portion is resiliently deformed about a joint portion between the sub-arm portion and the main arm so that a distal end of said sub-arm portion presses the flat type conductor.

9 Claims, 7 Drawing Sheets

ELECTRICAL CONNECTOR FOR FLAT TYPE CONDUCTOR

BACKGROUND OF THE INVENTION

1. Field of the Invention

The invention relates to an electrical connector for a flat type conductor.

2. Description of the Related Art

This kind of electrical connector is disclosed in, for example, Japanese Patent Application Kokai Number 7-142130.

As shown in FIG. 7(A), the connector comprises a plurality of flat type terminals 50 made by stamping a metal sheet. A plurality of slits 61 are arranged in parallel to each other in a housing 60 in a direction perpendicular to the paper for accommodating the terminals 50. The respective slits 61 communicate with each other at the upper left of the housing 60 to provide an opening 62. A pressing member 70 is rotatably provided at the opening 62.

Each terminal 70 comprises an upper arm 51 and a lower arm 52 in the housing 60 and a connection portion 53 outside the housing 60. The upper arm 51 is supported by the upper interior surface of the housing 60 and includes a rotation guide or fulcrum 54 having a substantially circular shape at the distal end thereof in the vicinity of the opening 62. The lower arm 52 is flexible and includes a contact portion 55 at the distal end thereof. The pressing member 70 is rotatable about the rotation guides 54 of the terminals 70 at a concave 72 having a shape of circular section or arc and includes a pressing portion 71 having an angle. The connector is placed at a predetermined position of a circuit board such that the connection portions 53 of the terminals 70 are connected to predetermined circuit traces by soldering.

When the pressing member is in an open position, a flat conductor, such as a flexible board F, is inserted into the connector such that a circuit portion formed on the lower face of the flexible board F is disposed on the contact portion 55 of the terminal 70. Then, as shown in FIGS. 7(B) and 7(C), the pressing member 70 is rotated toward a closed position so that the pressing portion 71 presses the flexible board F to thereby bring the circuit portion of the flexible board F into resilient-contact with the contact portion 55 for firm electrical connection between the flexible board F and the terminal 50.

In this kind of the conventional connector, the flexible board is downwardly pressed by the pressing member so that the circuit portion formed on the lower face of the flexible board is brought into resilient-contact with the contact portion of the terminal. Consequently, the flexible board is required to be inserted into the connector such that the circuit portion faces down.

However, sometimes, the layout of other components on the same circuit board makes it necessary that the flexible board be inserted into the connector such that the circuit portion faces up. The conventional connector, however, does not have sufficient design freedom to position the contact, failing to meet the requirement.

SUMMARY OF THE INVENTION

Accordingly, it is an object of the present invention to provide an electrical connector for a flat type conductor, capable of connecting the flexible board to the terminal even when the circuit portion of the flexible board is formed on the face upon which the pressing member puts pressure.

According to the present invention, an electrical connector for a flat type conductor comprises a housing having an opening, a plurality of terminals held in the housing, each terminal having at least one contact portion, and a pressing member provided at the opening of the housing for rotation between an open position where the flat type conductor is inserted and a closed position where a conductive part of the flat type conductor is brought into resilient-contact with the contact portion of the terminal. The flat type conductor includes every kind of flat conductor, such as a flexible circuit board and a flat cable, which is made flat and brought into contact with a contact portion of the terminal. It also includes such a flat conductor as the top end of the terminal sticks into the coating material of the flat conductor to be brought into contact of the conductor portion of the flat conductor.

Each of the terminal includes a base and a main arm having a first arm portion extending from the base toward the opening and a second arm portion extending substantially in the same direction as that of the first arm portion, at least one of the first and second arm portions having a sub-arm portion, wherein the flat type conductor is inserted between the first and second arm portions and the sub-arm portion is resiliently deformed about a joint portion between the sub-arm portion and the main arm during movement of the pressing member from the open position to the closed position so that a distal end of the sub-arm portion presses the flat type conductor.

Consequently, the flat type conductor is brought into contact with both the first and second arm portions of the terminal. That is, the flat type conductor can be brought into contact with the terminal even if the conductor portion is provided on either face thereof.

According to an aspect of the invention, the flat type conductor is disposed on a side of the first arm portion and, while the pressing member is moving from the open position to the closed position, the pressing member presses the flat type conductor against the contact portion of the second arm portion and the sub-arm portion of the second arm portion presses the flat type conductor against the contact portion of the first arm portion or the sub-arm portion of the first arm portion is pressed against the flat type conductor. Accordingly, if at least one of sub-arm portions of the first and second arm portions has the contact portion, the terminal is brought into contact with the flat type conductor.

The pressing member can be movably supported by a movement guide provided in the first or second arm portion.

There are several options where and how to provide the sub-arm portion. Firstly, the second arm portion has the contact portion at the top portion thereof in the extension direction thereof and the sub-arm portion extending from the intermediate portion thereof toward the base and being flexible about the intermediate portion. Secondly, the first arm portion has the sub-arm portion extending from the vicinity of the movement guide toward the base thereof. Thirdly, when the pressure member is moved to the closed portion, the first arm portion is deformed by the force from the pressure member so that the movement guide is displaceable. In the third case, the sub-arm portion of the first arm portion is not only deformed but also rotated so that the pressure between the sub-arm portion and the flat type conductor is increased.

Accordingly to the present invention, the movement of the pressure member between the open position to the closed position has many varieties including rotational movement, straight-line movement, and the mixture of the rotational and straight-line movements.

DESCRIPTION OF THE PREFERRED EMBODIMENT (First Embodiment)

Figure 1:
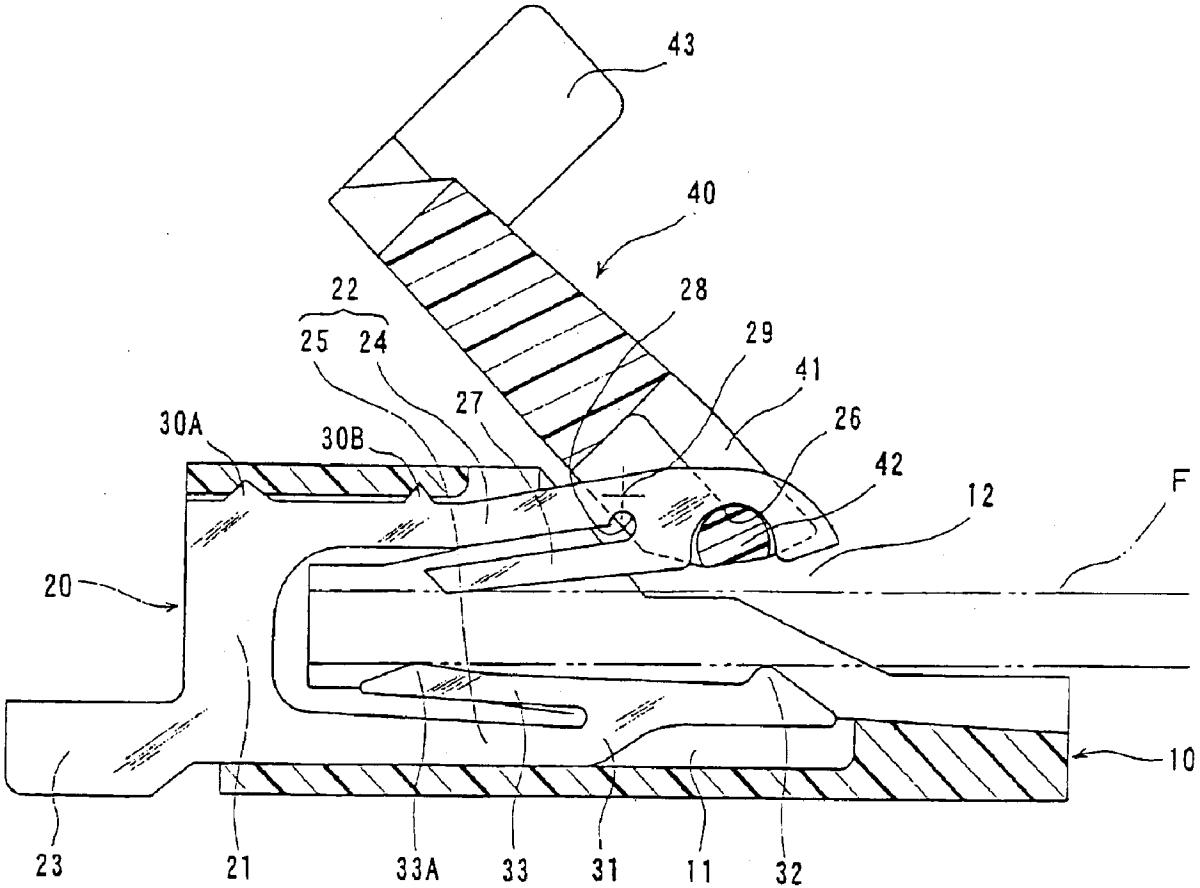
FIG. 1 is a sectional view of an electrical connector according to the first embodiment of the present invention, wherein a pressing member is in an open position.

In FIG. 1, an electrical connector according to the first embodiment of the invention comprises a housing 10 which is made of an insulating material, extends in a direction perpendicular to the paper, and has a shape of substantially rectangular parallelepiped. The housing 10 comprises a plurality of slits 11 which extend through the housing from right to left and are provided at predetermined intervals in the direction perpendicular to the paper. The housing 10 is cut off in the upper right thereof to provide an opening 12 in which a plurality of the slits 11 communicate with each other.

The terminal 20 is made by stamping a metal sheet such that flat faces of the metal are kept. The terminals 20 are inserted into and held in the respective slits 11. The terminal 20 comprises a main arm 22 extending from a base 21 to the right in the slit 21 and a connection portion 23 extending from the lower part of the base 21 to the outside of the housing 10. The main arm 22 comprises a first arm portion 24 extending from the upper part of the base 21 and a second arm portion 25 extending from the lower part of the base 21.

A free end of the first arm portion 24 extends up to the opening 12 of the housing 10. The first arm portion 24 includes a movement guide 26 having a shape of concave of substantially circular section or arc at the free end edge near the second arm portion 25. The movement guide 26 guides a pressing member described later to rotate and move. A sub-arm portion 27 extends from the left side of the movement guide 26 toward the base 21. A curved cut-off 28 is provided in the first arm portion 24 in the vicinity of the base of the sub-arm portion so that when receiving a force from outside, the sub-arm portion 27 is resiliently deformed in a rotation direction about a fulcrum 29 or a joint between the first arm and sub-arm portions 24 and 27. Projections 30A and 30B are provided on the upper edges of the base 21 and the first arm portion 24, respectively, to cut into the interior surface of the slit 11.

The second arm portion 25 extends substantially in parallel to the first arm portion 24 and substantially by the same length as that of the first arm portion 24. The second arm portion 25 comprises a stepped portion 31 in the middle thereof and a contact portion 32 at a free end thereof projecting toward the first arm portion 24. A sub-arm portion 33 extends from the stepped portion 31 toward the base 21. The sub-arm portion 33 comprises a bump 33A at the top end thereof. Thus, the free end of the second arm portion 25 and the sub-arm portion 33 are movable about the fulcrum 31 like a seesaw.

A pressing member 40 is rotatably and movably guided by the movement guide 26 of the first arm portion 24. The pressing member 40 is made of an insulating material and extends in a direction perpendicular to the paper to the extent of a plurality of the terminals 20. In FIG. 1, the pressing member 40 comprises a plurality of apertures or slits 41 at the lower side thereof at positions corresponding to respective terminals 20 to accommodate the free end of the first arm portion 24. The aperture 41 is provided with a guided portion 42 having a substantially circular shape which engages with the movement guide 26 of the terminal 20 so that the pressing member 40 rotates at the movement guide 26 from an open position shown in FIG. 1 to a closed position in the clockwise direction. The pressing member 40 comprises a control portion 43 at the upper part thereof which corrects the insertion angle of a flat type conductor when the conductor has been obliquely inserted.

How to connect the flat type conductor, such as a flexible board or flat cable, to the connector will be described below.

(1) The connector is placed on a circuit board so that the connection portions 23 of the terminals 20 are connected to corresponding circuit traces by soldering.

(2) As shown in FIG. 1, the pressing member 40 is rotated in the counter-clockwise direction to the open position. In the opening position, the opening 12 of the housing 10 is wide open and the space between the first and second arm portions 24 and 25 fully communicates with the outside space. The flat type conductor F is inserted into the space between the first and second arm portions 24 and 25. The conductor F is placed such that it is in light contact with or in the vicinity of the sub-arm portion 25 of the first arm portion 24, the contact portion 32 of the second arm portion 25, and the bump 33A of the sub-arm portion 33.

Figure 2A:
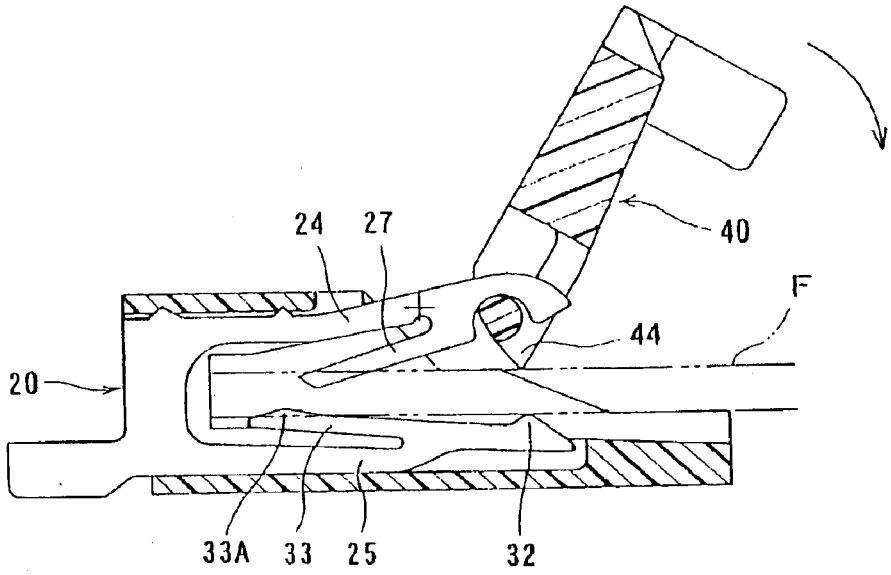
FIG. 2(A) is a sectional view of the connector of FIG. 1, wherein the pressing member is moving to a closed portion.

(3) In FIG. 2(A), the pressing member 40 is rotated in the clockwise direction so that a pressing portion 44 thereof presses the conductor F downwardly.

Figure 2B:
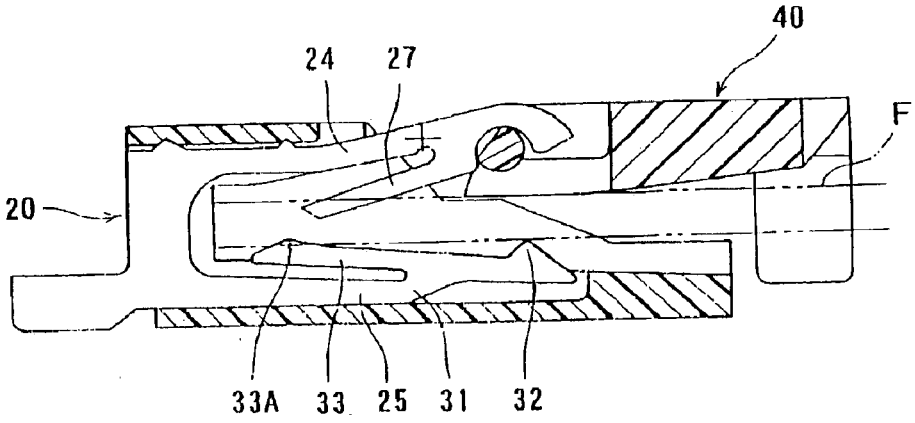
FIG. 2(B) is a sectional view of the connector of FIG. 1, wherein the pressing member is in the closed portion.

(4) The pressing member 40 is further rotated to the closed position in FIG. 2(B). The pressing member 40 keeps pressing the conductor F downwardly in the closed position. The conductor F presses the contact portion 32 of the second arm portion 25 positioned in the vicinity of the pressing portion 44 so that the second arm portion 25 is resiliently deformed downwardly and the sub-arm portion 33 is raised upwardly with the stepped portion 31 as a fulcrum. The bump 33A of the sub-arm portion 33 upwardly presses the conductor F against the sub-arm portion 27 of the first arm portion 24. Since the distance between the fulcrum (the stepped portion 31) and the bump 33A is greater than the distance between the fulcrum and the contact portion 32, the bump 33A is displaced more than the contact portion 32 by leverage.

(5) Also, the free end of the first arm portion 24 is raised upwardly by the pressing member 40, the sub-arm portion 27 is pressed downwardly with the fulcrum 29 as a supporting point and, in turn, presses the conductor F downwardly.

(6) Thus, the upper face of the flat type conductor F is brought into resilient-contact with the sub-arm portion 27 of the first arm portion 24 and the lower face of the conductor F is brought into resilient-contact with the contact portion 32 of the second arm portion 25 and the bump 33A of the sub-arm portion 33. Consequently, when the flat type conductor F is provided with a conductor, such as a circuit portion, at any of the resilient-contact positions, the conductor is electrically connected with the terminal 20. That is, the flat type conductor F can be electrically connected on the either upper or lower face thereof or at a plurality of positions (this feature is applicable for the below-described embodiments too). In FIG. 2, lines of the flat type conductor F and the parts of the terminal 20, which is brought into resilient-contact with the conductor F, overlap each other, indicating that the parts of the terminal 20 are resiliently deformed.

(Second Embodiment)

Figure 3:
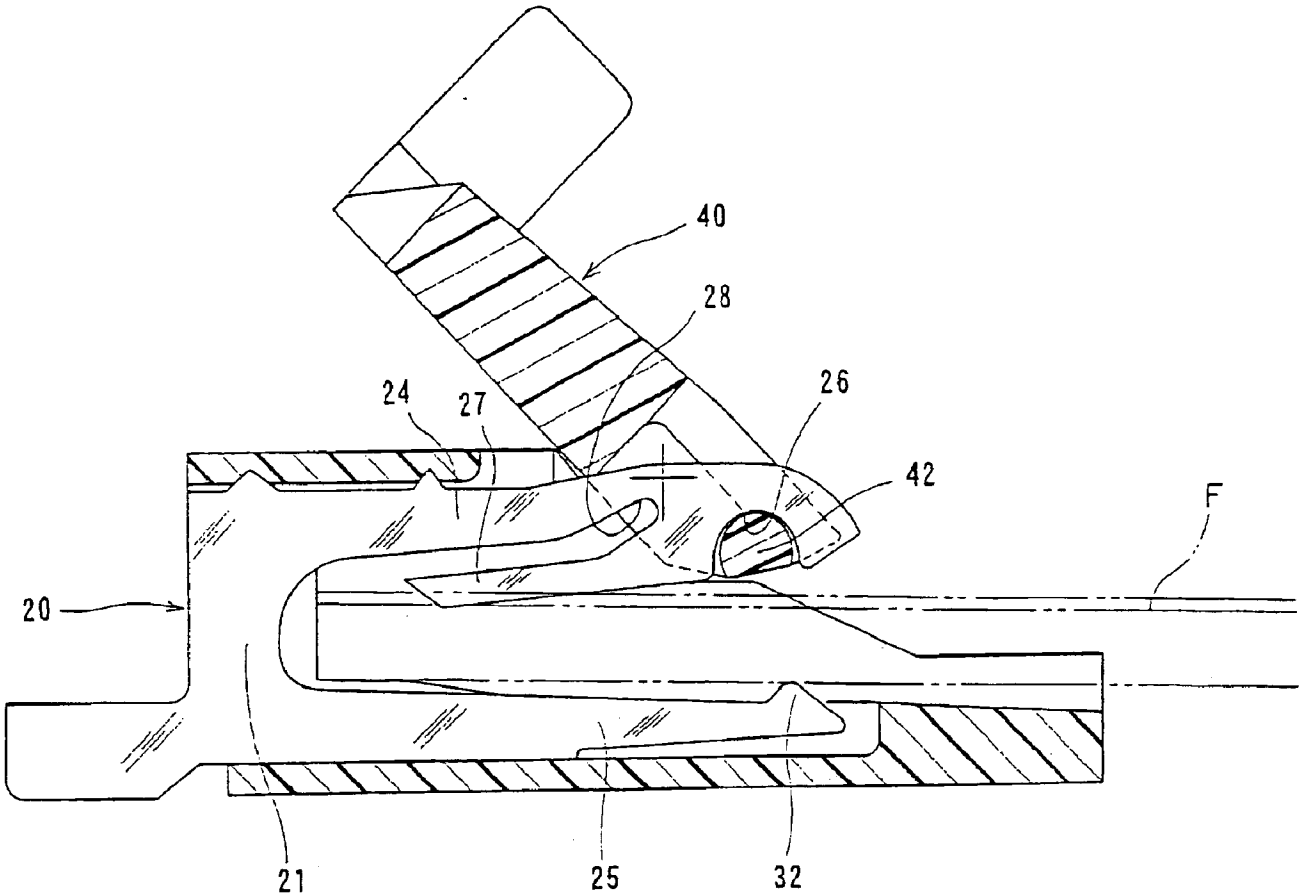
FIG. 3 is a sectional view of an electrical connector according to the second embodiment of the present invention, wherein a pressing member is in an open position.

In the second embodiment in FIG. 3, the same reference numbers are used for elements which are the same as or similar to those of the first embodiment. The differences of the second embodiment from the first embodiment are that the cut-off 28 of the first arm portion 24 is deeper than that of the first embodiment and the second arm portion 25 has neither sub-arm nor stepped portions and extends substantially straight from the base 21.

Figure 4A:
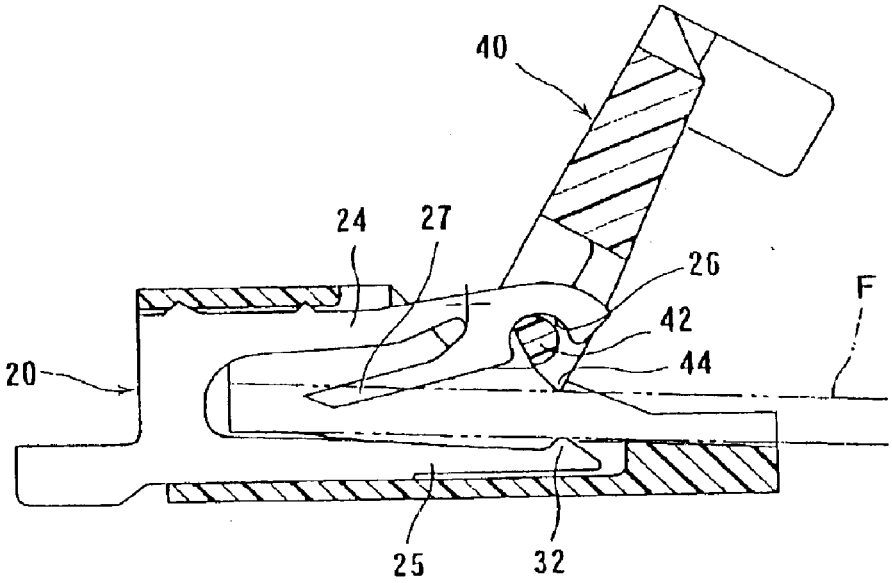
FIG. 4(A) is a sectional view of the connector of FIG. 3, wherein the pressing member is moving to a closed portion.

In FIG. 4(A), when the pressing member 40 is rotated toward the closed position, the pressing portion 44 receives the reaction force from the flat type conductor F in the upward direction and transmits it to the movement guide 26 of the terminal 20 via the guided portion 42. In the second embodiment, since the cut-off 28 is deeper than that of the first embodiment, the terminal 20 is more easily deformed to bring the right side portion from the cut-off 28 to a position higher than the left side portion from the cut-off 28.

Figure 4B:
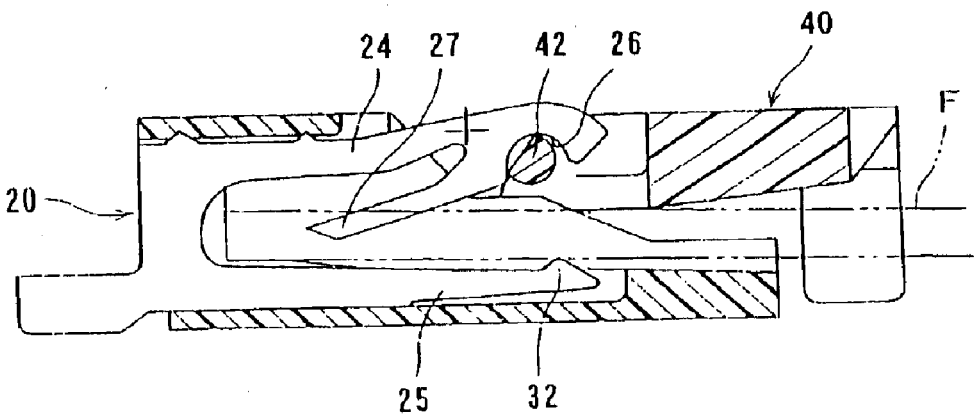
FIG. 4(B) is a sectional view of the connector of FIG. 3, wherein the pressing member is in the closed portion.

In FIG. 4(B), when the pressing member 40 is further rotated to the closed position, the pressure of the pressing portion 44 is reduced. Consequently, the terminal 20 is deformed to such a position as shown, bringing the top of the sub-arm portion 27 of the first arm portion 24 and the contact portion 32 of the second arm portion 25 into contact with the flat type conductor F with a predetermined pressure. The flat type conductor F is electrically connected with the contact portion 32 but may be electrically connected with the top of the sub-arm portion 27 by exposing a conductor part on the upper face of the flat type conductor F.

(Third Embodiment)

Figure 5:
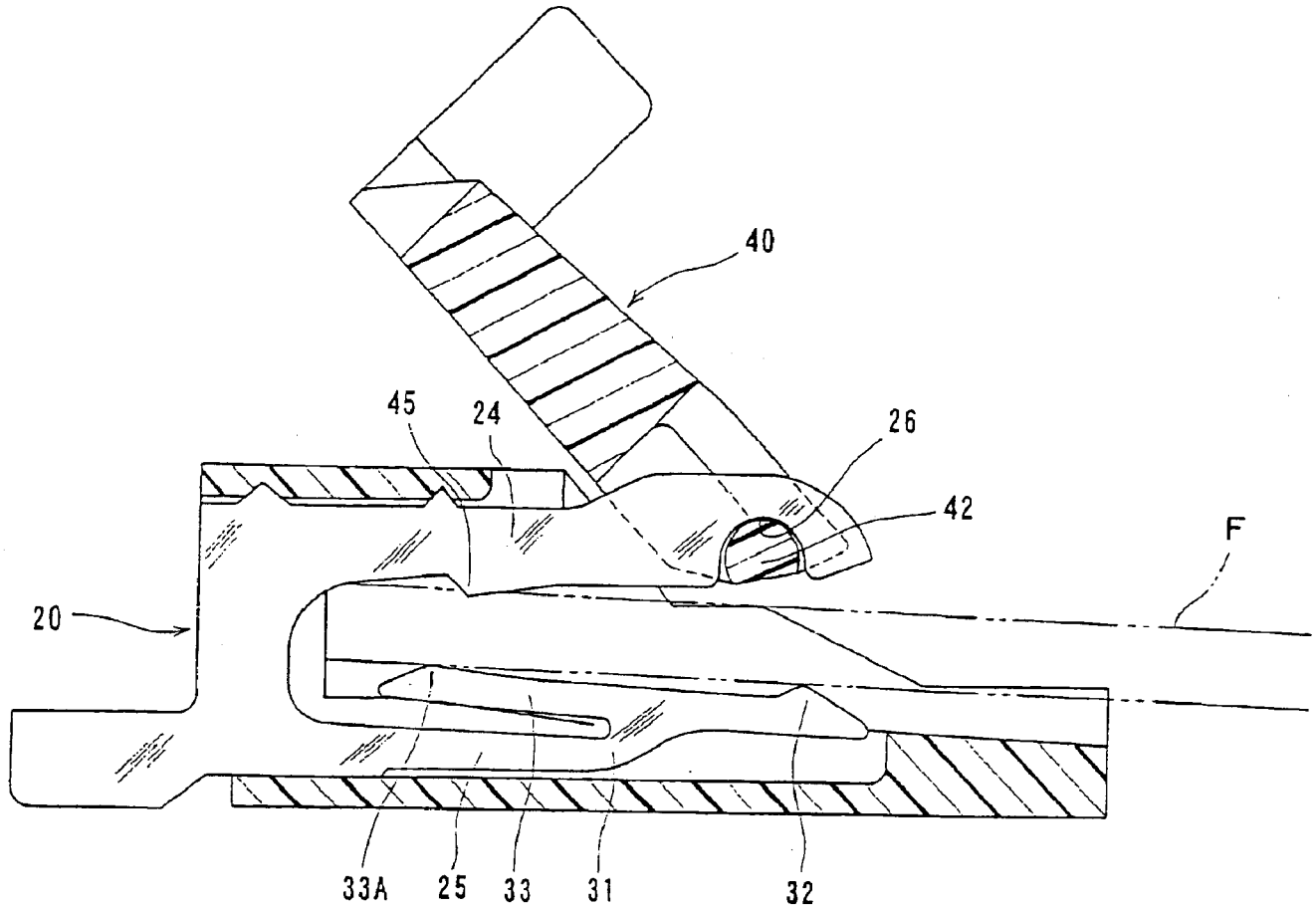
FIG. 5 is a sectional view of an electrical connector according to the third embodiment of the present invention, wherein a pressing member is in an open position.

In FIG. 5, the first arm portion 24 of the terminal according to the third embodiment has a contact projection 45 instead of the sub-arm portion. The contact projection 45 has a form of stepped portion on the first arm portion 24. In the third embodiment, the first arm portion is made so wide (in the up-and-down direction of the paper) that the resilient displacement is controlled. Accordingly, the resilient displacement is mainly caused in the second arm portion 25.

Figure 6A:
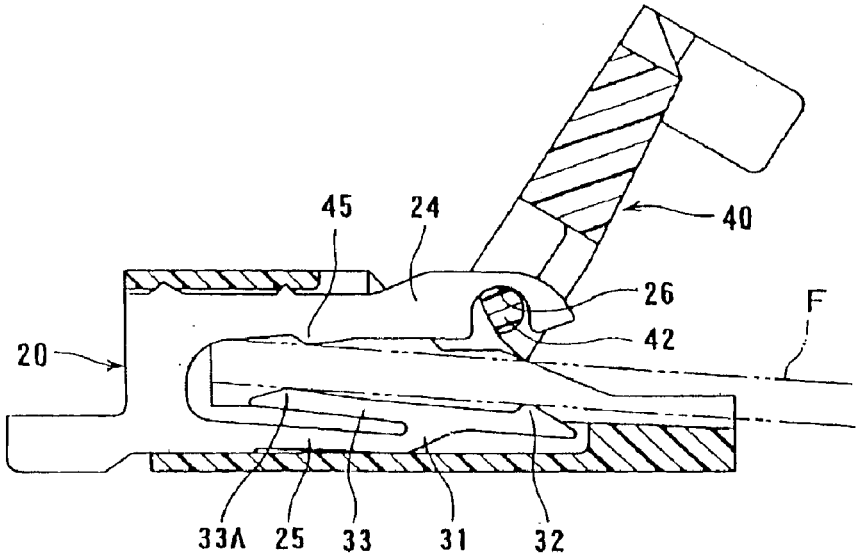
FIG. 6(A) is a sectional view of the connector of FIG. 5, wherein the pressing member is moving to a closed portion.
Figure 6B:
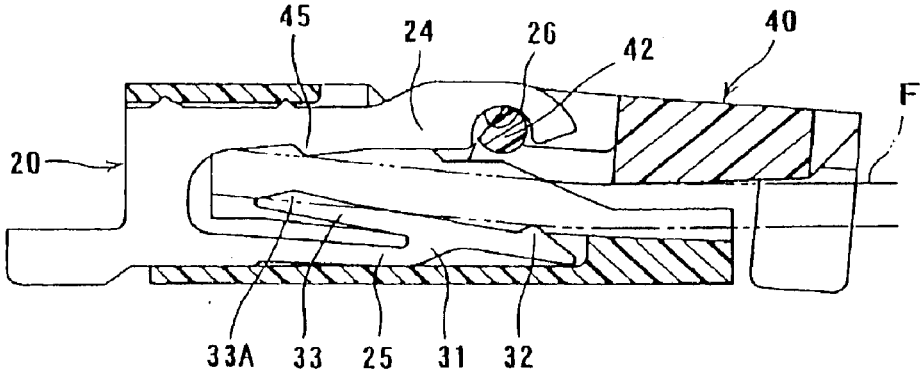
FIG. 6(B) is a sectional view of the connector of FIG. 5, wherein the pressing member is in the closed portion.
Figure 7A:
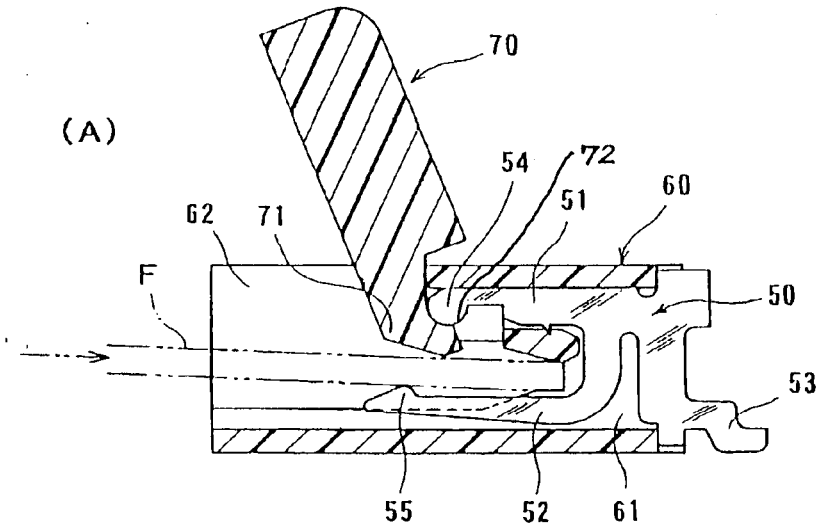
FIG. 7(A) PRIOR ART
FIGS. 7(A)–7(C) are sectional views of a conventional electrical connector, wherein a pressing member is in an open position, moving to a closed position, and in the closed position, respectively.
Figure 7B:
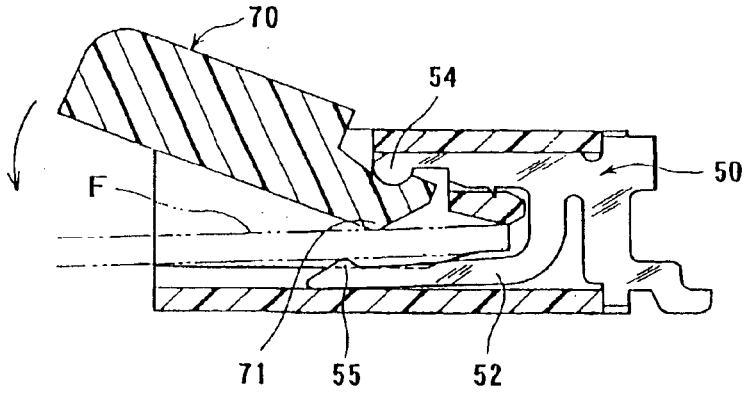
FIG. 7(B) PRIOR ART
Figure 7C:
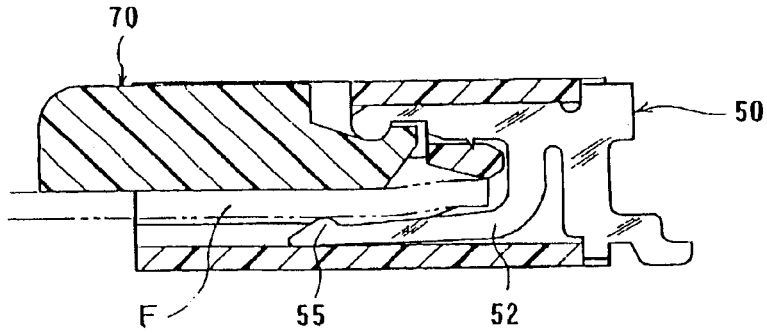
FIG. 7(C) PRIOR ART

In FIG. 6(B), when the flat type conductor F is pressed by the pressing member 40 in the closed position, the contact portion 32 is displaced downwardly, the bump 33A of the sub-arm portion 33 of the second arm portion 25 is raised, and the flat type conductor F is brought into contact with the contact projection 45 of the first arm portion 24 with a predetermined pressure. As described above, the flat type conductor F may be electrically connected with the bump 33A instead of the contact portion 32 or with both of the bump 32 and contact portion 32.

In the above embodiments, the reaction force from the flat type conductor is used to displace the sub-arm portion of the first arm portion. However, alternatively, cams may be provided at both ends (the end portions in a direction perpendicular to the paper) of the pressing member so that the free end of the first arm portion is raised upwardly when the pressing member is in the closed position.

As fully describe above, according to the present invention, when one face of the flat type conductor is pressed by the pressing member, the flat type conductor is brought into contact with not only either of first and second arm portions but also both the arm portions so that conductor parts are selectively provided on both the faces of the flat type conductor, thus expanding the design freedom and securing firm contact with both the faces of the flat type conductor.

What is claimed is:

1. An electrical connector for a flat type conductor, comprising:

a housing having an opening;

a plurality of terminals held in said housing, each terminal having at least one contact portion; and a pressing member provided at said opening of said housing for rotation between an open position where said flat type conductor is inserted and a closed position where a conductive part of said flat type conductor is brought into resilient-contact with said contact portion of said terminal, each of said terminal including a base and a main arm having a first arm portion extending from said base toward said opening and a second arm portion extending substantially in the same direction as that of said first arm portion, at least one of said first and second arm portions having a sub-arm portion, wherein said flat type conductor is inserted between said first and second arm portions and when said pressure member is moved to said closed position, said sub-arm portion is resiliently deformed about a joint portion between said sub-arm portion and said main arm so that a distal end of said sub-arm portion presses said flat type conductor.

2. The electrical connector according to claim 1, wherein said flat type conductor is disposed on a side of said first arm portion and when said pressing member is moved to said closed position, said pressing member presses said flat type conductor against said contact portion of said second arm portion and said sub-arm portion of said second arm portion presses said flat type conductor against said contact portion of said first arm portion or said sub-arm portion of said first arm portion is pressed against said flat type conductor.

3. The electrical connector according to claim 1 or 2, wherein at least one of said sub-arm portions of said first and second arm portions has said contact portion.

4. The electrical connector according to claim 1 or 2, wherein said pressing member is movably supported by a movement guide provided in said first arm portion.

5. The electrical connector according to claim 1 or 2, wherein said sub-arm portion of said first arm portion extends from vicinity of said movement guide toward base.

6. The electrical connector according to claim 1 or 2, wherein said first arm portion is deformed by a force from said pressing member so that said movement guide is displaceable while said pressing member is rotated from said open position to said closed position.

7. An electrical connector for a flat type conductor, comprising:

a housing having an opening;

a plurality of terminals held in said housing, each terminal having at least one contact portion; and a pressing member provided at said opening of said housing for rotation between an open position where said flat type conductor is inserted and a closed position where a conductive part of said flat type conductor is brought into resilient-contact with said contact portion of said terminal, each of said terminal including a base and a main arm having a first arm portion extending from said base toward said opening and a second arm portion extending substantially in the same direction as that of the said first arm portion, at least one of said first and second arm portions having a sub-arm portion, wherein said flat type conductor is inserted between said first and second arm portions and when said pressure member is moved to said closed position, said sub-arm portion is resiliently deformed about a joint portion between said sub-arm portion and said main arm so that a distal end of said sub-arm portion presses said flat type conductor, wherein said contact portion of said second arm portion is provided at a front end of said second arm portion and said sub-arm portion of said second arm portion extends from said joint portion provided in the middle of said second arm portion toward said base so that said sub-arm portion is flexible about said joint portion.

8. An electrical connector for a flat type conductor, comprising:

a housing having and opening;

a plurality of terminals held in said housing, each terminal having at least one contact portion; and a pressing member provided at said opening of said housing for rotation between an open position where said flat type conductor is inserted and a closed position where a conductive part of said flat type conductor is brought into resilient-contact with said contact portion of said terminal, each of said terminal including a base and a main arm having a first arm portion extending from said base toward said opening and a second arm portion extending substantially in the same direction as that of said first arm portion, at least one of said first and second arm portions having a sub-arm portion extending in a direction opposite to that of said main arm and a movement guide provided on a side of said opening with respect to said sub-arm portion and guiding said pressing member, wherein said flat type conductor is inserted between said first and second arm portions and when said pressing member is moved to said closed position, said sub-arm portion continues contact with said flat type conductor.

9. An electrical connector for a flat type conductor, comprising:

a housing having an opening;

a plurality of terminals held in said housing, each terminal having at least one contact portion; and a pressing member provided at said opening of said housing for rotation between an open position where said flat type conductor is inserted and a closed position where a conductive part of said flat type conductor is brought into resilient-contact with said contact portion of said terminal, each of said terminal including a base and a main arm having a first arm portion extending from said base toward said opening and a second arm portion extending substantially in the same direction as that of said first arm portion, at least one said first and second arm portions having a sub-arm portion extending in a direction opposite to that of said main arm, wherein said flat type conductor is inserted between said first and second arm portions and when said pressure member is moved to said closed position, said sub-arm portion is resiliently deformed about a joint portion between said sub-arm portion and said main arm so that a distal end of said sub-arm portion presses said flat type conductor.

* * * * *